US008205843B2

(12) United States Patent
Phillips et al.

(10) Patent No.: US 8,205,843 B2
(45) Date of Patent: Jun. 26, 2012

(54) ROLLERBALL LEVELING LEG

(75) Inventors: Bryan Thomas Phillips, Goodlettsville, TN (US); Edwin Koehler, Nashville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 225 days.

(21) Appl. No.: 12/552,748

(22) Filed: Sep. 2, 2009

(65) Prior Publication Data

US 2011/0050064 A1 Mar. 3, 2011

(51) Int. Cl.
*A47B 91/00* (2006.01)
*F16M 11/20* (2006.01)

(52) U.S. Cl. ..... 248/188.8; 248/188.1; 248/188.9; 248/188.2

(58) Field of Classification Search ..... 248/188.1, 248/188.8, 188.9, 188.2
See application file for complete search history.

(56) References Cited

U.S. PATENT DOCUMENTS 1,016,324 A * 2/1912 Dunn ..... 16/32
1,638,725 A * 8/1927 Chesnutt ..... 16/42 R
2,110,269 A * 3/1938 Horvath ..... 16/24
2,403,338 A * 7/1946 Butler ..... 108/64
3,455,526 A 7/1969 Sho
6,138,979 A * 10/2000 Morman ..... 248/638
6,418,578 B1 * 7/2002 Polevoy et al. ..... 5/200.1
6,854,160 B2 * 2/2005 Polevoy et al. ..... 16/26
6,871,379 B2 3/2005 Ebeling et al.
6,910,666 B2 * 6/2005 Burr ..... 248/188.4
6,923,419 B2 8/2005 George et al.
7,287,732 B2 * 10/2007 Balistreri ..... 248/188.4
7,325,412 B2 2/2008 Yun et al.
7,588,219 B2 * 9/2009 Levine et al. ..... 248/188.4
2006/0042306 A1 3/2006 Choi et al.
2006/0186288 A1 8/2006 Levine et al.

* cited by examiner

*Primary Examiner* — Terrell McKinnon
*Assistant Examiner* — Michael McDuffie
(74) *Attorney, Agent, or Firm* — Pearne & Gordon LLP

(57) ABSTRACT

A leveling leg for an appliance is provided, including a main shaft and a foot coupled to the main shaft. A recess extends at least partially into the foot and includes an opening through a bottom surface of the foot. A ball is adapted to be received within the recess. The opening substantially surrounds at least a portion of the ball and is configured to inhibit removal of the ball from the recess. In one example, the ball is adapted to be received within the recess by a snap-fit engagement with the at least one arm. In another example, a plurality of arms are at least partially disposed within the recess and cooperate at one end thereof to engage the ball at an area below a great circle of the ball to inhibit removal of the ball from the recess.

20 Claims, 3 Drawing Sheets

ROLLERBALL LEVELING LEG

RELATED APPLICATIONS

Not Applicable.

FIELD OF THE INVENTION

The present invention relates generally to a leveling leg for an appliance, and more particularly, to a leveling leg for an appliance having a rollerball.

BACKGROUND OF THE INVENTION

Household and commercial appliances, for example stoves, ranges, dishwashers, refrigerators, clothes washers and dryers, and other appliances, are often installed into their surrounding environment. Some common measures of the installation of an appliance are the degree to which the appliance is level, the height of the appliance, and the ease of moving the appliance, for example during installation, maintenance, or cleaning.

The performance of many appliances can be affected if they are not level during operation. For example, an oven that is not level will often bake cakes that are also not level. The height of an appliance is also a factor during installation. For example, it may be advantageous to adjust the height of an appliance to match its surrounding cabinetry or countertop. Further, appliances are often heavy and awkwardly shaped. For example, it may be difficult to maneuver appliances during installation, especially into limited or confined spaces, and/or it may also be necessary to move appliances to allow maintenance and cleaning of the appliances themselves and the areas around the appliances.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, A leveling leg for an appliance is provided. The leveling leg includes: a main shaft; a foot coupled to the main shaft; a recess extending at least partially into the foot and including an opening through a bottom surface of the foot; and a ball adapted to be received within the recess, wherein the opening substantially surrounds at least a portion of the ball and is configured to inhibit removal of the ball from the recess In accordance with another aspect of the present invention, a leveling leg is provided. The leveling leg includes: a main shaft; a foot coupled to the main shaft; a recess extending at least partially into the foot and including an opening through a bottom surface of the foot; a plurality of arms at least partially disposed within the recess; and a ball adapted to be received within the recess, the plurality of arms cooperating at one end thereof to engage the ball at an area below a great circle of the ball to inhibit removal of the ball from the recess.

In accordance with another aspect of the present invention, an appliance is adapted to rest upon a supporting surface. The appliance includes: a bottom surface; and a leveling leg coupled to the bottom surface and adapted to project a distance therefrom to support the appliance upon the supporting surface, including: a main shaft; a foot coupled to the main shaft and including a bottom surface; a recess extending at least partially into the foot and including an opening through the bottom surface; at least one arm at least partially disposed within the recess; and a ball adapted to be received within the recess by a snap-fit engagement with the at least one arm, the at least one arm reducing a size of the opening to be less than a maximum width of the ball to inhibit removal of the ball from the recess, the ball projecting a distance outward from the bottom surface of the foot when the ball is received within the recess.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
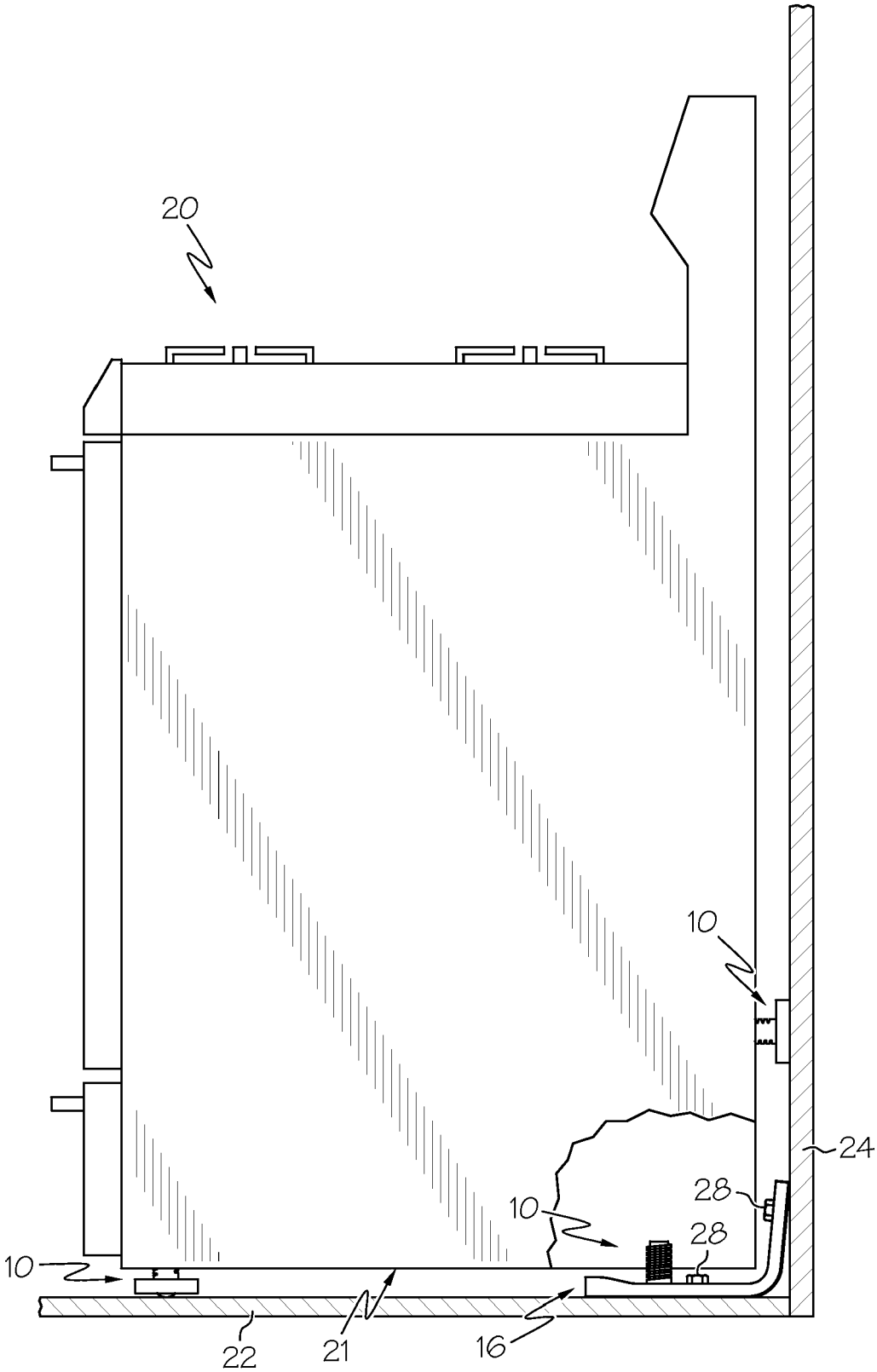
FIG. 1 illustrates a side view of an example range having an example leveling leg attached thereto.

An example embodiment of a device that incorporates aspects of the present invention is shown in the drawings. It is to be understood that the shown example is not intended to be a limitation on the present invention. For example, one or more aspects can be utilized in other embodiments and even other types of devices.

Turning initially to FIG. 1, an appliance 20 with an example leveling leg 10 is illustrated. As shown, the leveling leg 10 can be adapted for supporting the appliance 20, such as an oven or the like, upon or against a supporting surface 22, such as a floor (or even a wall 24). For clarity, the supporting surface 22 is described herein with reference to a floor, although it may include a wall 24 or other surface that can at least partially support the appliance 20. Thus, the leveling leg 10 can be adapted to engage various floor or wall types, such as concrete, brick, ceramic, linoleum, wood, carpet, plasterboard, metal, plastic, rubber, etc. Additionally, it is contemplated that the support surface can encompass structures other than a wall or floor. In one example, where appliances can be stacked upon each other (e.g., a dryer stacked upon a washing machine), the support surface can include a portion of the subjacent appliance (e.g., the top surface of the washing machine). Generally, one portion of the leveling leg 10 is coupled to the appliance 20, while another portion of the leveling leg 10 abuts the supporting surface 22 to thereby support the appliance 20. For example, one or more leveling leg(s) 10 can be coupled to a bottom surface 21 of the appliance 20, and can be adapted to project a distance from the bottom surface 21 to support the appliance 20 upon the supporting surface 22. As shown, the appliance 20 can include a plurality of leveling legs 10 disposed variously about a bottom portion of the appliance 20.

Optionally, one or more of the leveling legs 10 can be anchored to the supporting surface 22, such as by an anti-tip bracket 16 or the like, so as to inhibit or prevent the appliance 20 from tipping. The anti-tip bracket 16 can be fastened or anchored to either or both of the floor 22 or wall 24 (e.g., directly to the wall, to a toe board, or the like) in various manners such that the leveling leg 10 is constrained against movement when it is received therein. In one example, as shown, the anti-tip bracket 16 can include one or more holes (not shown) or the like adapted to receive fasteners 28 that are coupled to the support surface. In other examples, the anti-tip bracket 16 can be removably or non-removably anchored to a support surface by way of adhesives, welding, a snap connection, an interference fit, and/or it can even be formed with the support surface. The anti-tip bracket 16 is illustrated merely by way of example, and can be modified and adapted accordingly for use with various appliances, and/or various support surfaces. In addition or alternatively, the leveling leg 10 can also be adapted for use with an interlock switch assembly (not shown) or the like that can selectively permit or inhibit, such as prevent, operation of the appliance 20 under various conditions, such as where an anti-tip bracket is not installed, the range is not level, a leveling leg is not installed, etc.

Figure 2:
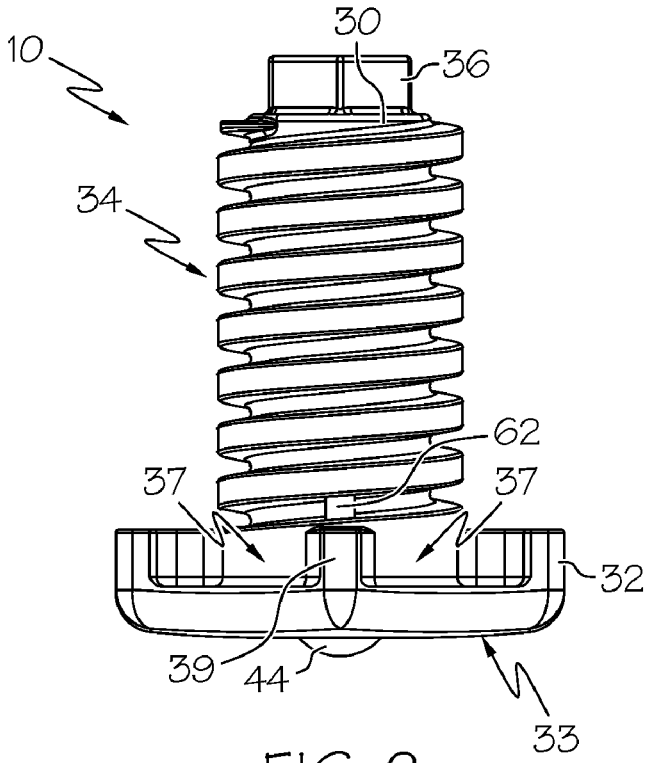
FIG. 2 illustrates a front view of an example leveling leg.

Turning to FIG. 2, the leveling leg 10 generally includes a main shaft 30 having a foot 32, such as an enlarged foot, at one end that is supported by a support surface (e.g., floor 22, see FIG. 1). For example, the foot 32 can include a bottom surface 33 that can be adapted to rest upon the supporting surface 22. The bottom surface 33 can include various removable or non-removable surface features that may alter engagement with the supporting surface 22, such as increase or decrease frictional grip, etc. The main shaft 30 of the leveling leg 10 can include an exterior threaded outer surface 34 extending at least partially along the main shaft 30 and above the foot 32 that engages with corresponding threaded structure on a bottom of an appliance 20 to permit the leveling leg 10 to be vertically adjustable. For example, the threaded outer surface 34 can permit adjustment of the distance between the bottom surface 21 of the appliance 20 and the supporting surface 22. Such vertical adjustability is desirable to allow the appliance 20 to be leveled at its installation location.

The leveling leg 10 can include structure to facilitate vertical adjustment thereof. In one example, the leveling leg 10 can include a hex-head 36 or the like for engagement with a wrench, socket, or the like for rotating the leg 10. In addition or alternatively, the leveling leg 10 can include one or more recesses 37, such as on a portion of the foot 32, for engagement with a tool (e.g., a screwdriver or wrench, etc.) to provide some mechanical advantage for rotating the leg 10, such as when the hex-head 36 is difficult or impossible to use. In addition or alternatively, the recesses 37 can be at least partially formed or defined by one or more strengthening webs 39 or the like that can provide strength to the leveling leg 10, while permitting a reduction in material used to form the leg 10. It can be beneficial to choose the minimum height of the leveling legs 10 to allow a tool or the like to fit underneath the appliance 20 to facilitate easy and rapid adjustment of the height of leveling leg 10. In addition or alternatively, the leveling leg 10 can include structure to avoid over-tightening of the leg 10, such as a thread stop 62 or the like adapted to engage structure of the appliance to inhibit, such as prevent, further rotation of the leveling leg 10.

As shown in FIG. 1, an appliance 20 typically includes a plurality of leveling legs 10, any or all of which can include a similarly threaded portion to provide individual vertical adjustability. However, any of all of the leveling legs 10 can also include various other methods to provide vertical adjustability. For example, a leveling leg can include a spring-loaded design or the like to provide for an "automatic" leveling of a particular leg. Still, some or all of the legs 10 can be fixed or otherwise non-adjustable. Additionally, the leveling leg 10 can also include various other features, such as a bore 38 extending partially or completely therethrough (see FIG. 5). In another example, the leveling leg 10 (and/or even the appliance 20) can include structure to inhibit, such as prevent, unwanted changes in the height of the leveling leg(s) 10 caused by vibration, use, or other reasons. For example, such structure can include lock nuts, lock washers, wedges, pins, molded or formed structure, material(s) held on by friction or adhesion, other mechanical fasteners, etc.

Figure 3:
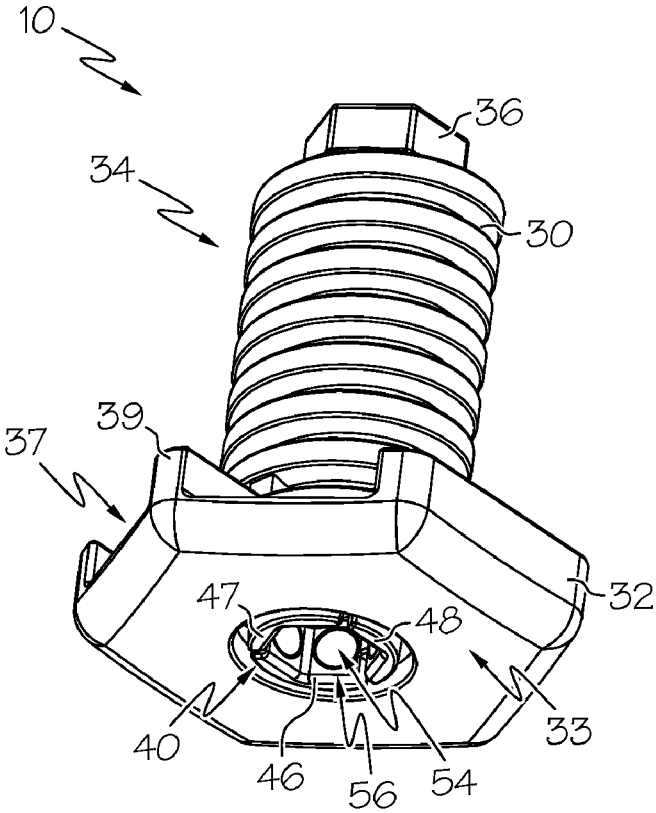
FIG. 3 illustrates a perspective view of the example leveling leg.
Figure 4:
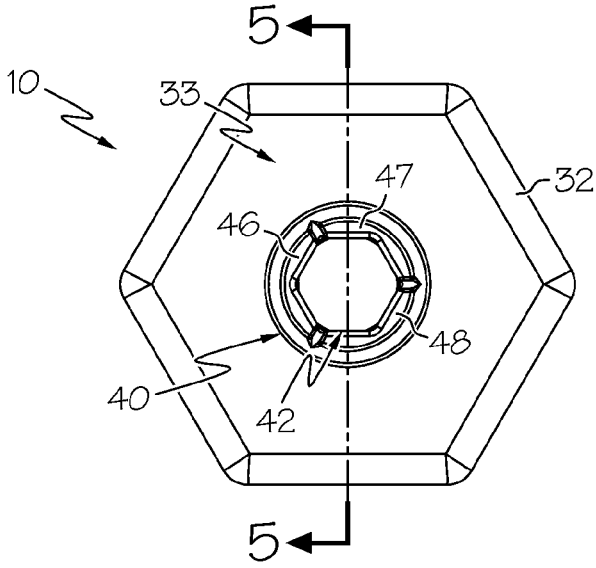
FIG. 4 illustrates a bottom view of the example leveling leg.
Figure 5:
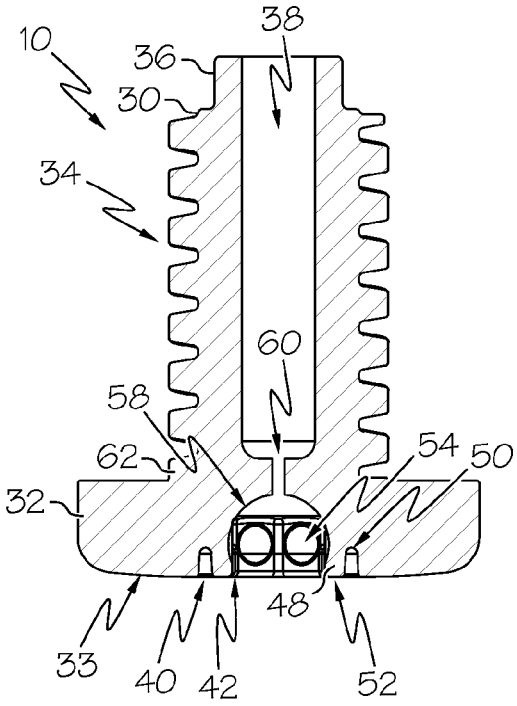
FIG. 5 illustrates a sectional view of the example leveling leg taken along line 5-5 of FIG. 4.

Turning now to FIGS. 3-5, the leveling leg 10 can further include a recess 40 extending at least partially into the foot 32. For example, as shown, the recess 40 can extend through a portion of the bottom surface 21 of the foot 32, and may include an opening 42 though the bottom surface 21 to thereby provide access to the recess 40. The recess 40 and/or opening 42 can have various geometries, such as circular, square, triangular, elliptical, polygonal, random, combinations thereof, etc. The recess 40 may be separated from the bore 38, or though not shown, may be in communication with the bore 38.

Figure 6:
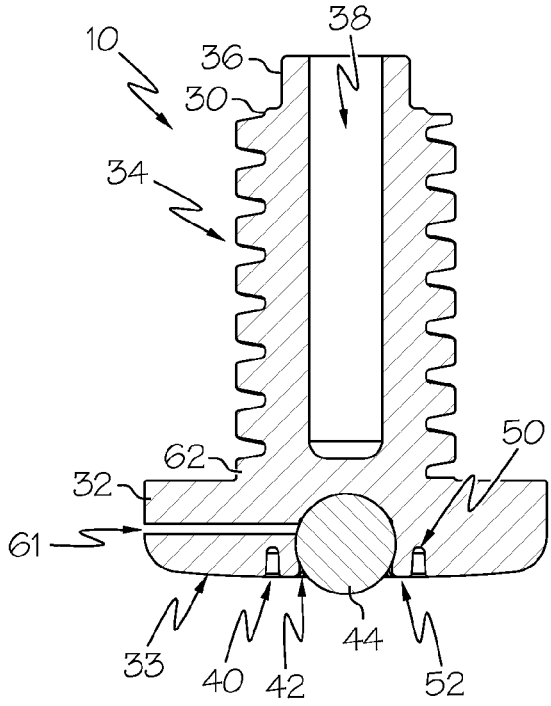
FIG. 6 illustrates another sectional view of the example leveling leg taken along line 6-6 of FIG. 4.

The leveling leg 10 can further include a ball 44 (which may be referred to herein as a "rollerball") adapted to be received within the recess 40. The ball 44 may be a sphere, as shown in the Figures, though may also be a polyhedron or the like. As shown in FIG. 6, a portion of the ball 44 can project a distance outward from the bottom surface 33 of the foot 32 when the ball 44 is received within the recess 40. Further, the recess 40 can be configured to permit the ball 44 to rotate therein. Thus, the ball 44 can rest upon the supporting surface 22 to thereby maintain a separation between the bottom surface 33 and the supporting surface 22, such that the appliance 20 can be more easily moved via rotation of the ball 44 within the recess 40.

The opening 42 can substantially surround at least a portion of the ball 44. For example, the opening 42 can substantially surround the portion of the ball 44 that passes through the opening 42 and out of the foot 32, though other portions are also contemplated. The opening 42 can also be configured to inhibit, such as prevent, removal of the ball 44 from the recess. In one example, the ball 44 can be retained within the recess 40 by a snap-fit engagement, such as a snap-fit engagement between the ball 44 and the opening 42. For example, the opening 42 can be formed of a generally resilient material, such as plastic or the like, while the ball 44 can be formed of a relatively harder material, such as a relatively harder plastic, hard rubber, metal, etc., such that insertion of the ball 44 into the recess 40 via the opening 42 can force a portion of the opening 42 to temporarily increase in size while the ball 44 is passing therethrough, whereupon the opening 42 can then return to its original size to thereby inhibit removal of the ball from the recess 40.

In addition or alternatively, the leveling leg 10 can further include at least one arm 46 partially disposed within the recess 40. The at least one arm 46 can define a portion, such as all, of the opening 42. Thus, the at least one arm 46 can substantially surround the ball 44 and can be configured to inhibit removal of the ball 44 from the recess 40. The at least one arm 46 can substantially surround at least a portion of the ball 44. For example, the at least one arm 46 can substantially surround the portion of the ball 44 that passes through the opening 42 defined by the at least one arm 46 and out of the foot 32, though other portions are also contemplated. In another example, the at least one arm 46 can substantially surround the portion of the ball 44 that resides within the recess 40.

As shown in FIG. 4, the at least one arm 46 can be part of a plurality of arms, such as three arms 46, 47, 48, although various numbers of arms are contemplated. The plurality of arms 46, 47, 48 can cooperate to form the opening 42. In one example, the plurality of arms 46, 47, 48 can each be coupled to the foot 32 at a first end 50 and can be at least partially separate from each other at a second end 52, such that all of the arms 46, 47, 48 are independently movable. Thus, any or all of the arms 46, 47, 48 can be movable away from each other for insertion or removal of the ball 44 within the recess 40. In one example, the main shaft 30, foot 32, recess 40, and at least one of the arms 46, 47, 48 (or even all of the arms 46, 47, 48) can be materially integral. In one example, the leveling leg 10 can be generally formed by a single operation, such as a single molding operation (or other manufacturing procedure). Further, the plurality of arms 46, 47, 48 can be provided generally equally within the recess 40, such that the arms 46, 47, 48 can generally self-center the ball 44 within the recess 40.

For example, the ball 44 can be retained within the recess 40 by a snap-fit engagement between the ball 44 and at least one of the arms 46, 47, 48. In one example, at least one of the arms 46, 47, 48 can be formed of a generally resilient material, such as plastic or the like, and can be resiliently coupled to the foot 32. The resiliency of the arms can act to provide a generally self-centering action of the ball 44 within the recess 40. As shown, all of the arms 46, 47, 48 can be formed of a generally resilient material and all can be resiliently coupled to the foot 32. For example, the first end 50 of each arm 46, 47, 48 can be formed with the foot 32 so as to be resiliently coupled thereto. The ball 44 can be formed of a relatively harder material, such as a relatively harder plastic, hard rubber, metal, etc., such that insertion of the ball 44 into the recess 40 via the opening 42 can force at least one of the arms 46, 47, 48 away from another of the arms 46, 47, 48 to temporarily increase the size of the opening 42 while the ball 44 is passing therethrough. For example, the second end 52 of each respective arm 46, 47, 48 can resiliently maintain the opening 42 at a size less than a maximum width of the ball 44. Thus, the opening 42 can define a width equal to or less than the great circle of the ball 44. Generally, a great circle of a sphere is a circle that runs along the surface of that sphere so as to cut it into two substantially equal halves, such that the great circle generally has both the same circumference and the same center as the sphere. For example, the great circle is substantially the largest circle that can be drawn on a given sphere.

Thus, forcing the ball 44 through the opening 42 can cause the second end 52 of at least one of the arms 46, 47, 48 to move away from the second end 52 of another of the arms 46, 47, 48 to thereby increase the size, such as the width, of the opening 42 to be substantially equal to or greater than a maximum width of the ball 44. In one example, one or more of the arms 46, 47, 48 can be moved so as to increase the size of the opening 42 to be equal to or greater than the great circle of the ball 44. After the largest width of the ball 44 has passed therethrough, the opening 42 can then return to its original size (i.e., the second end 52 of the arms 46, 47, 48 can resiliently return to their original positions) to thereby inhibit removal of the ball from the recess 40. In one example, the plurality of arms 46, 47, 48 can cooperate at one end thereof (i.e., the second end 52) to engage the ball 44 at an area below the great circle of the ball 44 to inhibit, such as prevent, removal of the ball from the recess 40.

Although the foregoing examples have been described with reference to a load-bearing leveling leg 10 for the appliance, it is to be understood that the leveling leg 10 can include other variations. Turning back to FIG. 1, for example, one or more leveling legs 10 can project from the appliance 20. For example, one leveling leg 10 is shown projecting from the bottom of the appliance 20, while another example leveling leg 10 is shown projecting from the rear of the appliance 20, though other locations are also contemplated. Either or both of the leveling legs 10 can be used, and either or both can be load-bearing or generally non-load-bearing. For example, although the leveling legs 10 are shown projecting from the bottom of the appliance 20, the weight of the appliance 20 can be partially or completely be supported by one or more other leveling legs and/or even other structure. For example, one or more leveling legs 10 can provide load-bearing support for the appliance 20, while one or more other leveling legs 10 can provide for movement of the appliance 20.

Thus, for example, some of the leveling legs 10 can operate as described for moving the appliance 20, though can be generally non-load-bearing so as to support little or no weight of the appliance 20. In another example, where four leveling legs 10 are generally evenly positioned about the four corners of an appliance, a front two of the leveling legs 10 can be conventional legs without a ball 44, while a rear two of the leveling legs 10 can be of the design here that include a ball 44. Thus, to move the appliance 20, the user may raise the front of the appliance 20 to thereby lift the front two leveling legs 10 off of the supporting surface 22, while using the balls 44 of the rear two leveling legs 10 to reposition the appliance 20. It is to be understood that leveling legs 10 of the present application can be utilized without a ball 44 installed within the recess 37 thereof in place of a conventional leveling leg. It is also be understood that any or all of the legs used to support the appliance 20 may or may not include level adjusting structure, such as the threaded outer surface 34 or the like.

In addition or alternatively, the leveling legs 10 can further include additional structure and/or features. In one example, it can be beneficial to increase, such as maximize, a size of the ball 44 to thereby decrease, such as minimize, a pressure point contact of the ball 44 with the supporting surface 22. Such a feature may inhibit, such as prevent, damage to the supporting surface 22 and/or reduce, such as minimize, a force required to move the appliance 20 upon the supporting surface 22. Similarly, the size of the recess 40 and/or opening 42 can be correspondingly increased. Thus, the geometry and/or various features of the leveling leg 10 may change to accommodate various sizes of the recess 40 and/or ball 44. Though not shown, each leveling leg 10 can include a plurality of recesses each containing one or more balls, which may also effectively reduce a pressure point contact with the supporting surface 22. In another example, it can be beneficial to decrease, such as minimize, the surface area contact between the ball 44 and the recess 40 and/or opening 42 to thereby decrease, such a minimize, frictional forces therebetween. For example, a relatively smooth surface material can be chosen for the ball 44, such as a chrome-plated metal or the like. Similarly, a corresponding material can be chosen for the recess 40, opening 42, arms 46, 47, 48, etc.

In addition or alternatively, the recess 40, opening 42, and/or arms 46, 47, 48 can include structure to reduce surface area contact and/or frictional forces with the ball 44. In one example, at least one of the plurality of arms 46, 47, 48 can include a curved aperture 54 on an interior surface 56 thereof (see FIGS. 3 and 5) adapted to provide clearance and/or rotational support for the ball 44 when the ball 44 is received within the recess 40. For example, as shown, each of the arms 46, 47, 48 can include a curved aperture 54 that can generally correspond to the exterior geometry of the ball 44. Thus, the curved apertures 54 can reduce, such as minimize, surface area contact between the ball 44 and the arms 46, 47, 48 to thereby decrease, such a minimize, frictional forces therebetween. Similarly, other portions of the recess 40 can include structure to reduce surface area contact and/or frictional forces with the ball 44. For example, an upper surface 58 of the recess 40 can include a curved geometry that can generally correspond to the exterior geometry of the ball 44 to reduce, such as minimize, surface area contact and/or frictional forces with the ball 44. In addition or alternatively, the recess 40, opening 42, and/or arms 46, 47, 48 can include other rotational support structure (not shown), such as ball bearings or the like.

In addition or alternatively, each of the arms 46, 47, 48 can include other structure and/or geometry to reduce, such as minimize, surface area contact with the ball 44. In one example, the second end 52 of at least one of the arms 46, 47, 48 can be provided with a geometry that reduces surface area contact with the ball 44. For example, the second end 52 of each of the plurality of arms 46, 47, 48 can cooperate to define the opening 42 as a polygon, such as a hexagon or other polygon. Similarly, the edge of some or all of the second ends 52 can have a curved geometry, such as an outwardly curved geometry, to further reduce surface area contact with the ball 44, and/or to facilitate ingress or egress of the ball 44 in or out of the recess 40. It is to be understood that the plurality of arms can include various other numbers of arms and can cooperate to define the opening 42 as various other shapes and geometries.

In addition or alternatively, various features can be provided to facilitate removal of the ball 44 from the recess 40. For example, a user may desire the remove the ball 44 from the recess 40 for maintenance, replacement, to inhibit a portion of the appliance 20 from moving, etc. In one example, a gap can be provided between an arm and the recess 40, or between one or more of the arms 46, 47, 48, to enable a user to insert a tool, such as a screwdriver or the like, for dislodging the ball 44 from the recess 40. The ball 44 can be directly or indirectly dislodged from the recess 40, such as by directly prying the ball 44 therefrom (e.g., such as by inserting the tool in a gap between two or more of the arms 46, 47, 48), or by utilizing the tool to temporarily increase the width of the opening 42 (e.g., such as by moving one or more of the arms 46, 47, 48 away from each other, etc.). In addition or alternatively, one or more apertures can be provided variously about and/or through various portions of the leveling leg 10 like to permit a tool to be inserted therethrough for dislodging the ball 44 out of the recess 40, such as by applying a force greater than that of the arm(s) 46, 47, 48 retaining the ball 44. In one example (see FIG. 5), an aperture 60 or the like can provide fluid communication between the bore 38 and the recess 40. In another example (see FIG. 6), an aperture 61 or the like can be accessible from the side, such as by extending through the foot portion 32 and into the recess 40.

It is also to be understood that the leveling legs of the subject invention can be used in settings other than in a range. For example, the leveling legs of the subject invention could be used in a refrigerator, freezer unit, icemaker, dishwasher, washing machine, dryer, or the like. Even further still, the leveling legs can be utilized in various other applications, such as furniture, power tools, shelving, computer equipment, exercise equipment, equipment supports, commercial or industrial equipment, and/or various other applications that may be subject to adjustable heights and/or level operation.

Additionally, the size and/or geometry of the leveling legs of the subject invention can also depend upon the type of appliance and/or the type of support surface it is intended to be used with. In the example embodiments, the leveling legs are sized to replace a conventional leveling leg of a conventional oven. However, the various elements of the leveling legs can be made larger to fit commercial appliances (e.g., commercial ovens, refrigerators, freezer units, icemakers, dishwashers, washers, dryers, or the like), or sized to fit various other applications in which the leveling leg is to be used. In such a case, the size and/or geometry of the leveling legs can be adapted accordingly. Further, it is to be understood that the various elements of the leveling legs can be made of suitable materials, such as metal, plastic, hard rubber, and the like. Further still, the various elements need not be constructed from the same materials.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A leveling leg for an appliance, including:
- a main shaft;
- a foot coupled to the main shaft;
- a recess extending at least partially into the foot and including an opening through a bottom surface of the foot;
- a plurality of arms at least partially disposed within the recess; and
- a ball adapted to be received within the recess through the opening, wherein the opening substantially surrounds at least a portion of the ball and is configured to inhibit removal of the ball from the recess,
- wherein at least two of the plurality of arms each include an aperture spaced apart from the opening, the apertures configured to provide rotational support for the ball when the ball is received within the recess.

2. The leveling leg of claim 1, wherein the ball is adapted to be retained within the recess by a snap-fit engagement.

3. The leveling leg of claim 1, wherein the plurality of arms substantially surround the ball and are configured to inhibit removal of the ball from the recess.

4. The leveling leg of claim 1, wherein at least one of the arms is resiliently coupled to the foot.

5. The leveling leg of claim 1, wherein the plurality of arms are each coupled to the foot at a first end and are separate from each other at a second end such that all of the arms are independently movable.

6. The leveling leg of claim 5, wherein the second end of the plurality of arms cooperate to define the opening as a polygon.

7. The leveling leg of claim 1, wherein all of the plurality of arms includea curved aperture on an interior surface thereof adapted to provide rotational support for the ball when the ball is received within the recess.

8. The leveling leg of claim 1, wherein the main shaft, foot, recess, and at least one arm are materially integral.

9. The leveling leg of claim 1, wherein the opening defines a width equal to or less than a great circle of the ball.

10. The leveling leg of claim 1, further including a threaded outer surface extending at least partially along the main shaft.

11. A leveling leg for an appliance, including:
- a main shaft;
- a foot coupled to the main shaft;
- a recess extending at least partially into the foot and including an opening through a bottom surface of the foot;
- a plurality of arms at least partially disposed within the recess, wherein the plurality of arms each include a first end coupled to the foot within the recess and wherein the plurality of arms are separate from each other at a second end such that at least two of the arms are independently movable; and a ball adapted to be received within the recess, the plurality of arms cooperating at the second end thereof to engage the ball at an area below a great circle of the ball to inhibit removal of the ball from the recess.

12. The leveling leg of claim 11, wherein at least one of the plurality of arms is resiliently coupled to the foot.

13. The leveling leg of claim 11, wherein the plurality of arms are separate from each other at the second end such that all of the arms are independently movable, the ball being retained within the recess by a snap-fit engagement with the plurality of arms.

14. The leveling leg of claim 11, wherein the plurality of arms cooperate, at the second end, to define the opening as a polygon.

15. The leveling leg of claim 11, wherein at least one of the plurality of arms includes a curved aperture on an interior surface thereof adapted to provide rotational support for the ball when the ball is received within the recess.

16. The leveling leg of claim 11, wherein the ball projects a distance outward from the bottom surface of the foot when the ball is received within the recess.

17. The leveling leg of claim 11, further including a threaded outer surface extending at least partially along the main shaft.

18. An appliance adapted to rest upon a supporting surface, including:

a bottom surface; and a leveling leg coupled to the bottom surface and adapted to project a distance therefrom to support the appliance upon the supporting surface, including:

a main shaft;

a foot coupled to the main shaft and including a bottom surface;

a recess extending at least partially into the foot and including an opening through the bottom surface;

a plurality of arms at least partially disposed within the recess, wherein the plurality of arms each include a first end coupled to the foot within the recess and a second end movable with respect to first end; and a ball adapted to be received within the recess by a snap-fit engagement with the plurality of arms, the second end of the plurality of arms reducing a size of the opening to be less than a maximum width of the ball to inhibit removal of the ball from the recess, the ball projecting a distance outward from the bottom surface of the foot when the ball is received within the recess.

19. The appliance of claim 18, wherein the plurality of arms include a plurality of independently-movable arms, the ball being retained within the recess by the plurality of arms.

20. The appliance of claim 18, wherein at least one of the plurality of arms includes a curved aperture on an interior surface thereof adapted to provide rotational support for the ball when the ball is received within the recess.

* * * * *